US009968151B1

(12) United States Patent
Cominsky

(10) Patent No.: US 9,968,151 B1
(45) Date of Patent: May 15, 2018

(54) TRANSPORT HOOD HAVING PERFORATIONS

(71) Applicant: John C. Cominsky, Clover, SC (US)

(72) Inventor: John C. Cominsky, Clover, SC (US)

( * ) Notice: Subject to any disclaimer, the term of this patent is extended or adjusted under 35 U.S.C. 154(b) by 4 days.

(21) Appl. No.: 15/205,901

(22) Filed: Jul. 8, 2016

(51) Int. Cl.
*A42B 1/20* (2006.01)
*A42B 1/04* (2006.01)
*A41B 1/00* (2006.01)

(52) U.S. Cl.
CPC ..... *A42B 1/041* (2013.01); *A42B 1/043* (2013.01)

(58) Field of Classification Search
CPC ..... A42B 1/046; A42B 1/04; A42B 1/041; A42B 1/048; A42B 1/045; A42B 1/201; A42B 1/067; A42B 1/22; A42B 3/105; A42B 3/28; A42B 7/00; A45D 44/12; A45D 8/40; A45D 20/18; A45D 44/22; A45D 44/08; A41D 13/1153; A41D 13/11; A41D 2200/20; A41D 13/1161; A41D 13/001; A62B 17/04; A62B 18/084; A62B 23/025; A61M 16/06; A61M 16/0627; A61M 16/0633; A61M 16/0666; A61M 16/0683; A61M 2205/0216; A61M 2210/0618
See application file for complete search history.

(56) References Cited

U.S. PATENT DOCUMENTS 128,451 A * 7/1872 Ackerman ..... A42B 1/247 2/10
806,099 A * 12/1905 Boehm ..... A42B 1/045 2/202
1,186,703 A * 6/1916 Sullivan ..... A42B 1/046 2/202
1,504,100 A * 8/1924 Danubio ..... A45D 8/40 132/274
1,678,649 A * 7/1928 Renault ..... A45D 44/22 2/174
1,800,051 A * 4/1931 Blanco ..... A41D 13/1153 128/201.25
2,184,240 A * 12/1939 McInnis ..... A45D 44/12 132/212
2,191,589 A * 2/1940 Sacks ..... A42B 1/046 2/174
2,355,283 A * 8/1944 Diss ..... A45D 44/12 128/201.23
2,446,122 A * 7/1948 Bills ..... A42B 1/041 2/174

(Continued)

*Primary Examiner* — Bobby Muromoto, Jr.

(74) *Attorney, Agent, or Firm* — Christopher C. Dremann, P.C.; Christopher C. Dremann

(57) ABSTRACT

A transport hood protects conveying personnel from exposure to blood and body fluids of a detainee and avoids discomfort and breathing difficulty to the detainee if the blood and body fluids accumulate and are retained within the transport hood. The transport hood includes a top portion made of an open mesh material that is positioned over the head of the detainee to below the eyes of the detainee. A bottom portion made of a breathable material impervious to the blood and body fluids of the detainee is joined to the top portion below the eyes of the detainee and extends downwardly to below the chin of the detainee. The bottom portion has a plurality of perforations formed through the breathable material that allow the blood and body fluids issued by the detainee to drain from the bottom portion of the transport hood under the influence of gravity.

19 Claims, 2 Drawing Sheets

(56) References Cited

U.S. PATENT DOCUMENTS 2,477,437 A * 7/1949 Borowick ..... A45D 44/12 2/174
2,869,132 A * 1/1959 Drummond ..... A01M 29/34 2/174
3,084,446 A * 4/1963 Freedman ..... A45D 20/18 2/204
3,241,155 A * 3/1966 Phillips ..... A45D 44/12 2/174
3,582,989 A * 6/1971 Fassbender ..... A01K 55/00 2/205
3,789,839 A * 2/1974 Lund ..... A62B 17/04 128/201.25
4,173,042 A * 11/1979 Krzewinski-Morris ..... A42B 1/041 2/174
4,589,408 A * 5/1986 Singer ..... A41D 13/11 128/201.25
4,698,853 A * 10/1987 Walton ..... A42B 1/046 2/174
4,785,481 A * 11/1988 Palmer, III ..... A61F 9/02 2/13
4,805,639 A * 2/1989 Dial ..... A41D 13/11 128/857
4,887,316 A * 12/1989 Morandini ..... A42B 1/046 2/174
4,979,236 A * 12/1990 Merrill ..... A01K 55/00 2/202
5,146,622 A * 9/1992 Blutstein ..... A42B 1/046 2/202
5,367,706 A * 11/1994 Davidson ..... A01K 55/00 2/171.03
5,664,262 A * 9/1997 Cominsky ..... A41D 13/11 128/857
5,708,982 A * 1/1998 Armani ..... A45D 8/40 2/171
5,842,231 A * 12/1998 Dawes ..... A01K 55/00 128/873
5,864,887 A * 2/1999 Kozawa ..... A42B 1/046 2/174
6,131,203 A * 10/2000 Cominsky ..... A42B 1/046 2/202
6,971,389 B2 * 12/2005 Collins ..... A41D 13/11 128/206.19
7,753,053 B2 * 7/2010 Dillon ..... A01K 15/003 119/717
8,109,271 B2 * 2/2012 Vandine ..... A61M 16/06 128/207.11
8,973,170 B2 * 3/2015 Cominsky ..... A42B 1/04 128/857
2004/0019957 A1 * 2/2004 Lewis ..... A42B 1/048 2/410
2005/0120452 A1 * 6/2005 Cominsky ..... A41D 13/11 2/9
2009/0151049 A1 * 6/2009 Conrardy ..... A42B 5/00 2/206
2009/0151055 A1 * 6/2009 Duncan ..... A62B 17/04 2/410
2009/0178176 A1 * 7/2009 Rowe ..... A42B 1/048 2/172
2014/0237705 A1 * 8/2014 Cominsky ..... A42B 1/04 2/410

* cited by examiner

TRANSPORT HOOD HAVING PERFORATIONS

FIELD OF THE INVENTION

The present invention relates to a protective head covering, and more particularly, to a transport hood for protecting conveying personnel from exposure to the blood and body fluids of a detainee. In exemplary embodiments, the invention is a transport hood including a top portion made of an open mesh material and a bottom portion made of a breathable fabric material having a plurality of perforations formed through the bottom portion.

BACKGROUND OF THE INVENTION

The number of detainees who are infected with the Human Immune Virus (HIV), Acquired Immune Deficiency Syndrome (AIDS) and other communicable diseases has increased dramatically. The transportation of detainees, such as mentally ill patients, persons under arrest and prisoners, invariably results in moments of high stress, duress and emotion. During these moments, the detainee may resist the conveying personnel, and thus, become injured to the extent that the detainee bleeds from around the mouth and/or nose. In addition, the detainee may intentionally or accidently issue body fluids, such as spit or vomit, onto the conveying personnel while resisting against efforts to restrain the detainee. In view of the associated health and safety risks, personnel who convey these detainees must take care to avoid contact with the detainee's blood and body fluids.

Protective head coverings, known as transport hoods, have long been utilized to protect conveying personnel as well as to protect the detainee from the surrounding environment. Prior transport hoods are made of a breathable fabric material and are provided with one or more fairly small openings adjacent the eyes of the detainee to allow the detainee an opportunity to see. Conveying personnel are required to take additional time to orient the openings in the transport hood with the eyes of the detainee. The additional time that the conveying personnel are in close proximity to the detainee increases the risk that the conveying personnel may come in contact with the blood and/or body fluids of the detainee. Further, oftentimes the openings do not remain aligned with the eyes of the detainee. In such instances the transport hood restricts the vision of the detainee and prevents the conveying personnel from observing the eyes of the detainee from every angle.

A protective head covering is disclosed in U.S. Pat. No. 1,186,703 to Sullivan. Sullivan discloses a protective head covering, or hood, for use by an operator of a baling press or threshing machine. The Sullivan hood shields the head, eyes, nose, mouth and neck of the operator from dust and small particles of debris, such as straw. However, the Sullivan hood includes a pair of discrete openings that must be properly oriented adjacent the eyes of the operator. Furthermore, the Sullivan hood is not intended to prevent bacteria, blood and body fluids of the operator from being projected into the surrounding environment.

U.S. Pat. No. 4,589,408 to Singer discloses a protective head covering for use as a surgical mask and hood. The Singer mask and hood blocks the passage of bacteria from the wearer's head into the surrounding environment and simultaneously protects the wearer from bacteria, blood and body fluids issued by a patient. However, the Singer mask and hood likewise includes a discrete opening that must be oriented with the eyes of the wearer. Furthermore, the Singer mask does not permit the eyes of the wearer to be observed from every angle.

U.S. Pat. No. 5,664,262 to Cominsky discloses a transport hood for protecting conveying personnel from exposure to the body fluids of a detainee. The transport hood disclosed by the Cominsky '262 patent includes a top portion and a bottom portion each constructed of a different material. The top portion is made of an open mesh material, and thus, is substantially transparent. The bottom portion is made of a breathable plastic or fabric cloth which is impervious to blood and body fluids issued by the detainee. The top portion of the transport hood covers the head of the detainee to just below the eyes, while the bottom portion covers the head of the detainee from just below the eyes to just below the chin. A first circumferential length of elastic joins the top portion to the bottom portion to gather the top portion and the bottom portion together just below the eyes of the detainee, and to hold the transport hood securely on the head of the detainee. An optional second circumferential length of elastic may be provided on the lowermost edge of the bottom portion to secure the transport hood about the neck of the detainee.

U.S. Pat. No. 6,131,203 to Cominsky discloses a cinching grommet for use with the transport hood of the Cominsky '262 patent. The cinching grommet disclosed by the Cominsky '203 patent consists of a thin disk made of a flexible plastic material having at least one opening formed therethrough for receiving an excess amount of the open mesh material of the top portion of the transport hood. The cinching grommet grasps and secures the excess material of the top portion so that the transport hood can be properly positioned on the head of the detainee with the lowermost edge of the top portion and the uppermost edge of the bottom portion gathered together just below the eyes of the detainee.

The transport hood taught by the aforementioned Cominsky '262 and '203 patents has been well received by law enforcement agencies and others as being effective for protecting conveying personnel from exposure to the blood and body fluids of a detainee. In certain instances, however, the bottom portion of the transport hood can cause discomfort to the detainee since the breathable fabric material is impervious to blood and body fluids issued by the detainee. In particular, if the transport hood is improperly used or misused, blood, spit and/or vomit issued from the detainee may accumulate and be retained within the bottom portion of the transport hood. If a substantial amount of blood, spit or vomit accumulates and is retained within the bottom portion of the transport hood the detainee could experience difficulty breathing and potentially be rendered unconscious due to oxygen deprivation (hypoxia). Unless conveying personnel properly position and secure the transport hood on the head of the detainee, and thereafter adequately monitor the detainee, blood and/or body fluids issued from the detainee could accumulate within the bottom portion of the transport hood and cause the detainee to potentially suffer a hypoxic brain injury or cardiac arrest.

U.S. Pat. No. 8,973,170 to Cominsky discloses a transport hood for protecting conveying personnel from the body fluids of a detainee that addresses the aforementioned concern. Namely, that the bottom portion made of a breathable fabric material entirely impervious to the blood and body fluids of a detainee may cause discomfort or potential injury as a result of breathing difficulty. The Cominsky '170 patent instead discloses a transport hood having a top portion and a bottom portion that are both made of an open mesh material with the top portion and the bottom portion being joined together and gathered just below the eyes of the detainee by a first circumferential length of elastic. A skirt made of a breathable material that is impervious to the blood and body fluids of the detainee is attached to the first length of elastic. The skirt hangs loosely and extends downwardly from the first length of elastic such that any blood or body fluids issued by the detainee will pass through the open mesh material of the bottom portion, but will not accumulate and be retained within the skirt.

The construction of the transport hood disclosed by Cominsky '170 effectively alleviates the potential concern of affixation of the detainee. In some instances and under certain circumstances, however, the skirt hanging loosely and being attached only to the first length of elastic may be considered by some conveying personnel to create a separate concern. Furthermore, the additional material of the skirt and the added step of attaching the skirt to the first length of elastic unnecessarily increase the material, manufacturing and assembly cost of the transport hood.

As is now apparent, an improved transport hood for protecting conveying personnel from the blood and body fluids of a detainee is needed that not only prevents blood and body fluids issued by the detainee from being spread into the surrounding environment, but also protects the detainee from discomfort and potential breathing difficulty that could result from blood and body fluids that accumulate and are retained within the bottom portion of the transport hood. The present invention, as described herein, provides an improved transport hood that protects conveying personnel from the blood and body fluids of a detainee and avoids discomfort to the detainee and possible breathing difficulty caused by blood or body fluids that may accumulate and be retained within the bottom portion of the transport hood.

SUMMARY OF THE INVENTION

The invention is a transport hood used to cover the head of a person who is being detained, referred to herein as a "detainee," such as a mentally ill patient or an individual, such as a person under arrest or a prisoner, in the custody of law enforcement personnel. Detainees are subject to carrying, and possibly spreading, bacteria, pathogens, and infectious and contagious diseases that can be communicated through contact with the blood and/or body fluids of the detainee. The transport hood acts as a barrier between the blood and body fluids of the detainee and the surrounding environment to protect personnel who handle, transport, or convey, the detainee. The transport hood also acts to avoid discomfort to the detainee and possible breathing difficulty that could result if the blood or body fluids of the detainee accumulate and are retained within the transport hood.

A transport hood according to the invention includes a dome-shaped top portion constructed of a substantially transparent material, such as an open mesh plastic, composite or fabric material. As used herein, the term "fabric" refers to a cloth produced by weaving or knitting textile fibers. The transport hood further includes a cylinder-shaped bottom portion constructed of a breathable plastic, composite or fabric material that is impervious to blood and body fluids. A lowermost edge of the top portion and an uppermost edge of the bottom portion are joined together by a first circumferential length of elastic. The top portion and the bottom portion thereby form a unitary dome-shaped structure with the top portion and the bottom portion joined and gathered together at the first length of elastic. As a result, the top portion and the bottom portion are not easily separated (e.g. torn apart) under normal conditions of wear and use.

The top portion of the transport hood covers the head of the detainee to just below the eyes. The bottom portion of the transport hood covers the head of the detainee from just below the eyes to just below the chin. The top portion and the bottom portion are gathered together by the first length of elastic at the lowermost edge of the top portion and the uppermost edge of the bottom portion just below the eyes of the detainee. Preferably, the first length of elastic is sufficiently elastic to hold the transport hood securely on the head of the detainee, without causing discomfort or being particularly restraining.

An optional second circumferential length of elastic may be provided around the lowermost edge of the bottom portion of the transport hood. The second length of elastic is sufficiently elastic to allow the transport hood to be stretched easily over the head of the detainee, while securing the transport hood around the neck of the detainee without causing discomfort or restricting the breathing of the detainee. In addition, the first length of elastic and the second length of elastic prevent the detainee from removing the transport hood while his or her arms are restrained.

The open mesh material of the top portion of the transport hood does not significantly obstruct the detainee's vision. In addition, the open mesh material of the top portion permits conveying personnel to observe the head of the detainee from every angle. The breathable material of the bottom portion of the transport hood does not inhibit the detainee's breathing. The impervious nature of the material of the bottom portion, however, adequately protects conveying personnel from exposure to blood and body fluids that may be accidently or intentionally issued (i.e., expelled) by the detainee.

Although the use of rubber gloves is now commonly mandated for conveying personnel, gloves protect only the hands of the conveying personnel from exposure to the detainee's blood and body fluids. The impervious nature of the breathable plastic, composite or fabric material of the bottom portion of the transport hood prevents blood and body fluids that issue from the nose and mouth of the detainee from being transmitted to the conveying personnel. Accordingly, the transport hood significantly reduces the risk that conveying personnel may be infected with communicable diseases, such as HIV and AIDS, spread through contact with the blood or body fluids of a detainee. Preferably, the transport hood is not reused and is properly disposed of after a single use to ensure that the blood or body fluids from one detainee are not communicated to another detainee or to other persons.

The transport hood of the present invention also avoids discomfort and possible breathing difficulty to the detainee as a result of blood or body fluids accumulating and being retained within the bottom portion of the transport hood. In particular, the bottom portion of the transport hood is provided with at least one, and preferably, a plurality of perforations in the form of narrow openings, cuts, slits or the like formed through the breathable material of the bottom portion. The perforations prevent blood and body fluids, such as blood, spit and/or vomit, issued by the detainee from accumulating and being retained within the bottom portion of the transport hood. Specifically, the perforations allow the blood and body fluids of the detainee to drain out of the bottom portion of the transport hood under the influence of gravity.

BRIEF DESCRIPTION OF THE DRAWINGS

Various exemplary embodiments of the invention are illustrated in the accompany drawing figures, wherein like reference characters are used to identify the same or similar parts, components, features or elements of the invention in the different views.

DETAILED DESCRIPTION OF THE VARIOUS EMBODIMENTS

Figure 1:
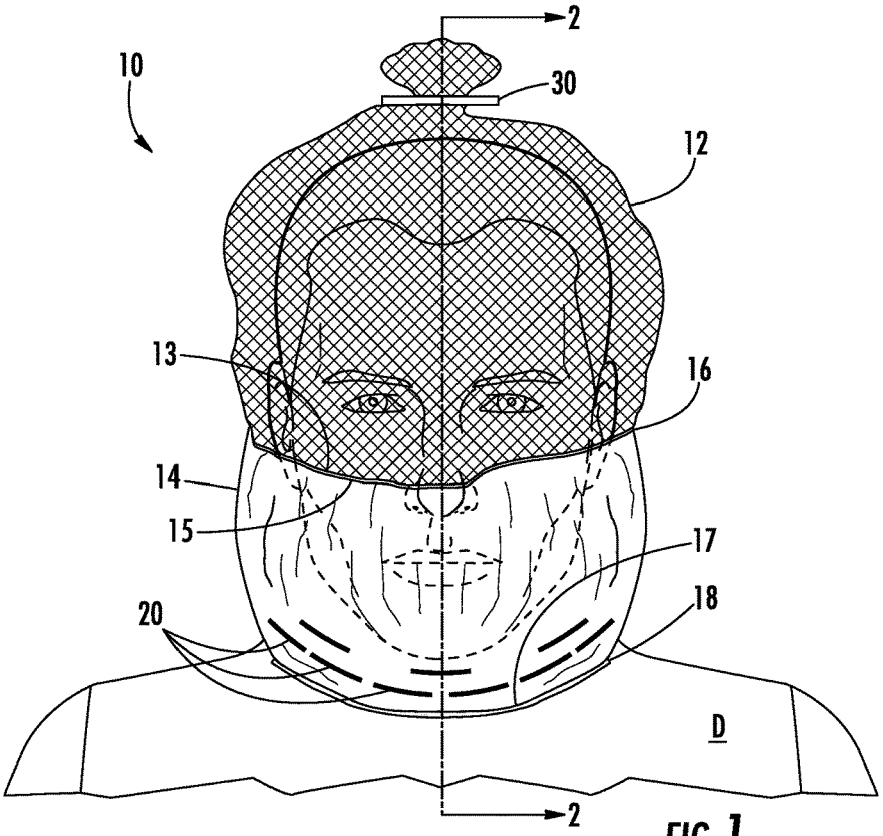
FIG. 1 is an environmental front elevation view showing an exemplary embodiment of a transport hood according to the invention including a top portion and a bottom portion having a plurality of perforations with the transport hood positioned over the head of a detainee.

Referring now specifically to the drawing figures, FIG. 1 is an environmental front elevation view of a protective head covering, referred to herein as a transport hood, 10 according to the invention. The transport hood 10 comprises a generally dome-shaped top portion 12 and a generally cylinder-shaped bottom portion 14. As shown herein, a lowermost edge 13 of the top portion 12 is joined to an uppermost edge 15 of the bottom portion 14 by a first length of an elastic material 16 that extends around the circumference of the transport hood 10. As a result, the top portion 12 and the bottom portion 14 of the transport hood 10 together define a unitary, generally dome-shaped structure that is substantially symmetric about an axis indicated by the section line 2-2 in FIG. 1 that is oriented vertically in the accompanying drawing figures. As shown herein, an optional second length of elastic material 18 extends around the circumference of the transport hood 10 at a lowermost edge 17 of the bottom portion 14.

The transport hood 10 is configured to be positioned over the head of a detainee, indicated generally by reference character D, such as a mentally ill patient, or a person under arrest or a prisoner in the custody of law enforcement personnel. Typically, the transport hood 10 is used to protect law enforcement personnel and other custodians, collectively referred to herein as "conveying personnel," from exposure to blood and/or body fluids issued by the detainee D. As shown, the top portion 12 of the transport hood 10 covers the upper portion of the head of the detainee D from just below the eyes, for example at the bridge of the nose, upwards to the top of the head. In the exemplary embodiments shown and described herein, the top portion 12 is made of a substantially transparent material, and more particularly, an open mesh material. The open mesh material may be formed from a sheet or a film of a plastic or composite material. In a preferred embodiment, however, the open mesh material is formed from a fabric material, such as a cloth produced by weaving or knitting textile fibers. In a particularly advantageous embodiment, the top portion 12 is made of a relatively fine, open mesh nylon material. The openings provided in the open mesh material are sized large enough so that the vision of the detainee D is not significantly obstructed, but are not so large as to interfere with identification of the facial features (e.g., eyes, nose, ears, etc.) of the detainee, or to allow the detainee to reposition the transport hood 10 while his or her arms are restrained.

As shown, the bottom portion 14 covers the lower portion of the head and at least a portion of the neck of the detainee D from just below the detainee's eyes, for example at the bridge of the nose, downwards to the detainee' neck. The bottom portion 14 is made of a breathable plastic, composite or fabric material that is impervious to liquids, and in particular, is impervious to the blood and body fluids of the detainee D, such as blood, spit and/or vomit. In a particularly advantageous embodiment, the bottom portion 14 is made of a material that is breathable, yet is impervious to bacteria borne by the blood and body fluids that may issue from the detainee D. The bottom portion 14 may be made of a substantially transparent, a translucent or an opaque material. In a particularly advantageous embodiment, the bottom portion 14 is made of a substantially opaque polypropylene cloth material of the type commonly used in medical and surgical apparel that provides an effective barrier against pathogens borne by blood and body fluids. Such a material is commonly referred to as a "medical grade fabric." If desired, the bottom portion 14 may comprise two or more layers made of the same material, or of a different material. Regardless, the material of the bottom portion 14 does not significantly inhibit, restrict or interfere with the ability of the detainee D to breathe normally.

The first circumferential length of elastic 16 is preferably sewn to the lowermost edge 13 of the top portion 12 and to the uppermost edge 15 of the bottom portion 14 so that the top portion and the bottom portion are not easily torn apart under conditions of normal wear and use. The first length of elastic 16 gathers the top portion 12 and the bottom portion 14 of the transport hood 10 just below the eyes of the detainee D, yet loosely retains the transport hood 10 on the head of the detainee without being uncomfortable or unreasonably restraining. The second circumferential length of elastic 18 is preferably sewn to the lowermost edge 17 of the bottom portion 14 of the transport hood 10. The second length of elastic 18 may have substantially the same length as the first length of elastic 16, but preferably, has a shorter length and/or greater elasticity. Regardless, the second length of elastic 18 is long enough, or alternatively elastic enough, to allow the transport hood 10 to be easily stretched over the head of the detainee D and to subsequently secure the transport hood around the neck of the detainee without being uncomfortable or interfering with the ability of the detainee to breathe normally.

Figure 2:
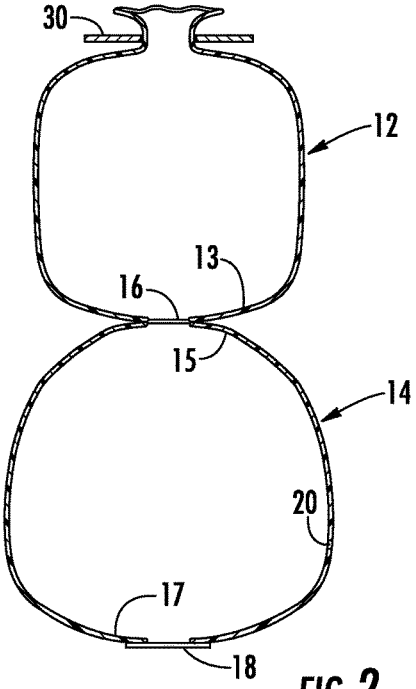
FIG. 2 is a sectional side elevation view of the transport hood taken along the line 2-2 indicated in FIG. 1.

FIG. 2 is a sectional side elevation view of the transport hood 10 configured to protect conveying personnel from exposure to the blood and body fluids of a detainee D. As shown in FIG. 1 and FIG. 2, the transport hood 10 comprises at least one, and preferably, a plurality of perforations 20 formed through the bottom portion 14 that are provided to avoid any discomfort and possible breathing difficulty experienced by the detainee D as a result of blood or body fluids of the detainee that may accumulate and be retained within the bottom portion of the transport hood.

The perforations 20 are formed through the breathable plastic, composite or fabric material of the bottom portion 14. As such, the perforations 20 form at least one, and preferably, a plurality of perforated or continuous openings through the breathable material of the bottom portion 14. The perforations 20 may be formed in any suitable manner, for example by cutting, punching, impaling or otherwise penetrating through the breathable material of the bottom portion 14. In one embodiment, the perforations 20 define generally elongate, relatively narrow cuts or slits formed through the breathable material of the bottom portion 14. As illustrated in FIG. 1, the perforations 20 comprise a plurality of generally elongate, relatively narrow, continuous slits that are arranged in at least a pair of generally parallel, generally horizontal rows.

When the transport hood 10 is positioned over the head of the detainee D, the perforations 20 are located between the mouth and the neck of the detainee. In a particularly advantageous embodiment, the perforations 20 are located on the bottom portion 14 proximate the lowermost edge 17 of the bottom portion and the optional second circumferential length of elastic 18 so that the perforations are positioned slightly below the chin of the detainee D. Locating the perforations 20 below the chin of the detainee D prevents the detainee from accidently or intentionally expelling body fluids, such as blood, spit, vomit and/or expectorant, from his or her nose or mouth outwardly into direct contact with conveying personnel.

As shown, the perforations 20 are generally linear shaped. However, if desired, the perforations 20 may be nonlinear shaped, for example curvilinear or shaped with a complex curvature. In addition, the perforations may be oriented in a generally vertical direction, in a generally horizontal direction, or alternatively, in one or more random directions. The perforations 20 may have any suitable length, but preferably, are between about one-half inch in length and about four inches in length. More preferably, each perforation is between about one inch in length and about two inches in length. The perforations 20 may have any suitable width, but preferably, are between about one-quarter of an inch in width and about three-quarters of an inch in width. Regardless, the perforated or continuous openings, cuts or slits of the perforations 20 alleviate discomfort to the detainee D by increasing ventilation in the bottom portion 14 of the transport hood 10 and by preventing any blood or body fluids issued by the detainee, such as blood, spit, vomit and/or expectorant, from accumulating and being retained within the bottom portion of the transport hood. Thus, the detainee D is not subjected to discomfort or possible breathing difficulty that could cause injury to the detainee D as a result of unconsciousness and/or hypoxia.

A transport hood 10 according to the present invention may also comprise an optional cinching grommet 30 of the type shown and described in the aforementioned Cominsky '203 patent issued to the same inventor. The cinching grommet 30 has an opening formed therethrough configured to receive an amount of the top portion 12 of the transport hood 10 sufficient to position the first circumferential length of elastic 16, and consequently, the lowermost edge 13 of the top portion 12 and the uppermost edge 15 of the bottom portion 14, just below the eyes of the detainee D, for example at the bridge of the nose. The cinching grommet 30 gathers and secures the appropriate amount of the top portion 12 of the transport hood 10 so that the perforations 20 are properly positioned for the particular size and shape of the head of the detainee D when the transport hood is secured over the head of the detainee. In this manner the perforations 20 formed through the breathable material of the bottom portion 14 effectively protect conveying personnel from exposure to, contact with, and/or transmittal of the blood and body fluids of the detainee D, while at the same time avoiding discomfort and possible breathing difficulty to the detainee.

Figure 3:
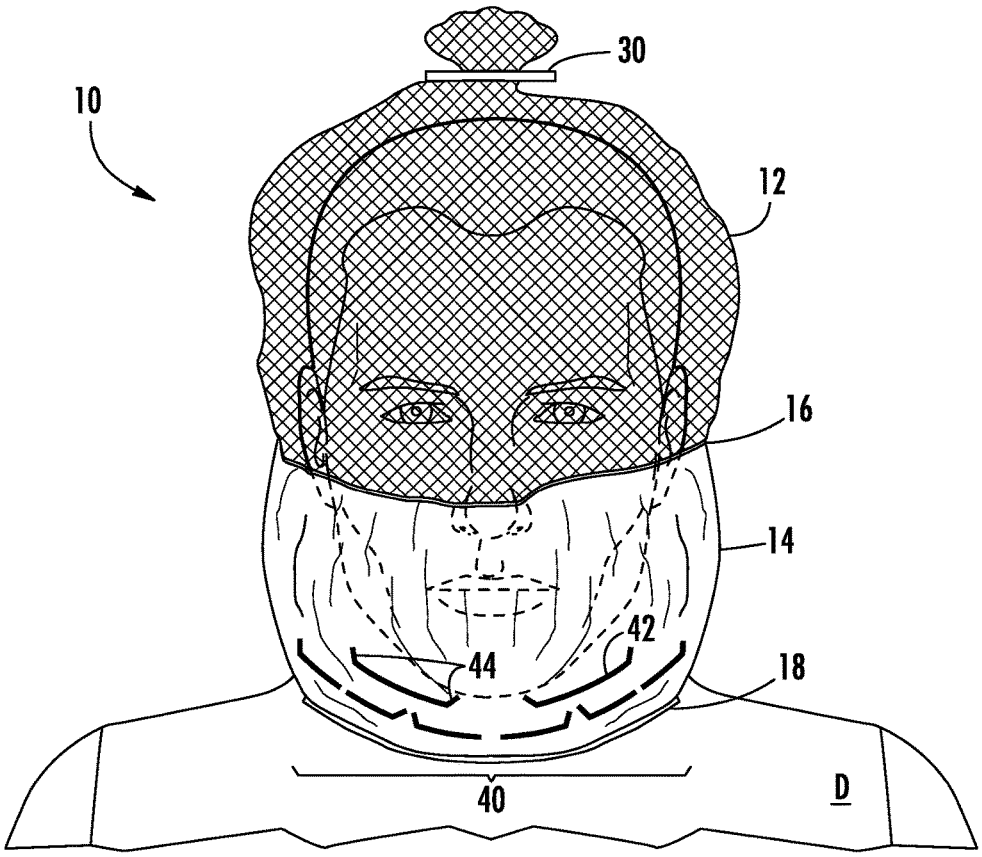
FIG. 3 is an environmental front elevation view showing another exemplary embodiment of a transport hood according to the invention with an alternative pattern of the plurality of perforations formed through the bottom portion and the transport hood positioned over the head of a detainee.

FIG. 3 is an environmental front elevation view of another exemplary embodiment of a transport hood 10 according to the present invention. As illustrated in FIG. 3, the perforations 40 may take the form of louvered cuts or slits located just below the chin of the detainee D. As such, each perforation 40 comprises a generally linear or curvilinear primary portion 42 and an angled extension portion 44 at one or both ends of the primary portion. Alternatively, one or more of the perforations 40 may define a relatively narrow chevron shape that is oriented in a generally horizontal direction. Regardless, each louvered perforation 40 defines an extensible flap that tends to extend outwardly under the influence of a positive pressure behind the breathable material of the bottom portion 14 of the transport hood 10. Accordingly, blood or body fluids of the detainee D that accumulate within the bottom portion 14 of the transport hood 10 cause the louvered perforation(s) 40 to extend outwardly (i.e. open) and thereby allow the blood or body fluids of the detainee to drain from the breathable, yet impervious, bottom portion of the transport hood under the influence of gravity. As shown, the perforations 40 may define one or more generally parallel, generally horizontal, rows of elongate, relatively narrow louvered cuts or slits, as previously described with respect to perforations 20. Furthermore, each of the perforations 40 may be generally linear in shape, generally curvilinear in shape, or alternatively, shaped with a complex curvature.

Exemplary embodiments of a transport hood 10 according to the present invention for protecting conveying personnel, while avoiding discomfort and possible breathing difficulty to a detainee, have been shown and described herein. However, the scope of the present invention is not intended to be limited in any manner to the specific embodiments illustrated herein or by the description of the embodiments provided herein. Instead, the present invention, and in particular the appended claims, are intended to be given the broadest reasonable interpretation consistent with the written description and accompany drawing figures.

That which is claimed is:

1. A transport hood for a detainee, comprising:

a top portion made of an open mesh material that is substantially transparent and configured to extend over and around the head of the detainee, the top portion having a lowermost edge; and a bottom portion made of a breathable material that is impervious to blood and body fluids of the detainee and configured to extend around the head of the detainee, the bottom portion having an uppermost edge and a lowermost edge;

wherein a plurality of perforations are formed through the breathable material of the bottom portion and located so as to be positioned between the mouth and the neck of the detainee with the transport hood secured over the head of the detainee, the perforations being configured and operable to allow the blood and body fluids of the detainee to drain from the breathable material and thereby prevent the blood and body fluids of the detainee from accumulating and being retained within the bottom portion of the transport hood.

2. The transport hood of claim 1, wherein each of the perforations defines an elongate, relatively narrow, slit having a length between about one-half inch and about four inches.

3. The transport hood of claim 2, wherein each of the perforations has a length between about one inch and about two inches and a width between about one-quarter inch and about three-quarters inches.

4. The transport hood of claim 1, wherein each of the perforations defines a continuous linear slit.

5. The transport hood of claim 1, wherein each of the perforations defines a continuous nonlinear slit.

6. The transport hood of claim 1, wherein each of the perforations defines a louvered slit comprising a primary portion and an angled extension portion disposed on at least one end of the primary portion.

7. The transport hood of claim 1, wherein the perforations define two or more generally parallel rows of elongate, relatively narrow, slits.

8. The transport hood of claim 1, wherein the material of the top portion is a fine mesh nylon material.

9. The transport hood of claim 1, wherein the material of the bottom portion is a substantially opaque polypropylene cloth.

10. The transport hood of claim 1, further comprising a first length of elastic disposed between the top portion and the bottom portion for gathering the top portion and the bottom portion below the eyes and above the nose of the detainee.

11. The transport hood of claim 10, wherein the first length of elastic is attached to the lowermost edge of the top portion and to the uppermost edge of the bottom portion.

12. The transport hood of claim 10, further comprising a second length of elastic for gathering the bottom portion just below the chin of the detainee.

13. The transport hood of claim 12, wherein the second length of elastic is attached to the lowermost edge of the bottom portion.

14. The transport hood of claim 12, wherein the first length of elastic secures the transport hood on the head of the detainee and the second length of elastic secures the transport hood around the neck of the detainee.

15. A transport hood for conveying a detainee and for protecting conveying personnel from exposure to blood and body fluids of the detainee, while avoiding discomfort and potential breathing difficulty to the detainee as a result of the blood and body fluids accumulating and being retained within the transport hood, the transport hood comprising:

a dome-shaped top portion made of a substantially transparent open mesh material and having a lowermost edge, the top portion configured to be positioned over the head of the detainee with the lowermost edge of the top portion between the eyes and the nose of the detainee; and a cylinder-shaped bottom portion made of a breathable material that is impervious to the blood and body fluids of the detainee, the bottom portion having an uppermost edge joined to the lowermost edge of the top portion, the bottom portion being configured to extend downwardly to below the chin of the detainee, the bottom portion having a plurality of perforations formed through the breathable material that are operable for allowing the blood and body fluids of the detainee to drain from the bottom portion of the transport hood.

16. The transport hood of claim 15, wherein the breathable material is a substantially opaque, medical grade polypropylene cloth.

17. The transport hood of claim 15, further comprising a first length of elastic disposed between the lowermost edge of the top portion and the uppermost edge of the bottom portion for gathering the top portion and the bottom portion below the eyes and above the nose of the detainee.

18. The transport hood of claim 17, further comprising a second length of elastic disposed at the lowermost edge of the bottom portion for gathering the bottom portion below the chin and about the neck of the detainee.

19. The transport hood of claim 15, further comprising a cinching grommet having an opening formed therethrough for receiving and securing an amount of the top portion sufficient to position the lowermost edge of the top portion and the uppermost edge of the bottom portion below the eyes and above the nose of the detainee when the transport hood is secured on the head of the detainee.

* * * * *